US008038276B2

(12) United States Patent
Mimura

(10) Patent No.: US 8,038,276 B2
(45) Date of Patent: Oct. 18, 2011

(54) INK CARTRIDGE AND ITS RECYCLING METHOD

(75) Inventor: Shinya Mimura, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 658 days.

(21) Appl. No.: 12/205,322

(22) Filed: Sep. 5, 2008

(65) Prior Publication Data

US 2009/0079803 A1 Mar. 26, 2009

(30) Foreign Application Priority Data

Sep. 26, 2007 (JP) ..... 2007-249578

(51) Int. Cl.
*B41J 2/175* (2006.01)

(52) U.S. Cl. ..... 347/86; 347/50

(58) Field of Classification Search ..... 347/50, 347/84–87

See application file for complete search history.

(56) References Cited

U.S. PATENT DOCUMENTS

| | | | | |
|---|---|---|---|---|
| 6,620,308 | B2 | 9/2003 | Gilbert | |
| 7,510,251 | B2 * | 3/2009 | Wanibe et al. | 347/7 |
| 2009/0035580 | A1 | 2/2009 | Chino et al. | |

FOREIGN PATENT DOCUMENTS

| | | | |
|---|---|---|---|
| JP | 7-17052 | A | 1/1995 |
| JP | 2001-55201 | A | 2/2001 |
| JP | 2003-504504 | A | 2/2003 |
| JP | 2005-33734 | A | 2/2005 |
| WO | WO-2007018239 | A1 | 2/2007 |

* cited by examiner

*Primary Examiner* — Thinh Nguyen

(74) *Attorney, Agent, or Firm* — Birch, Stewart, Kolasch & Birch, LLP

(57) ABSTRACT

An ink cartridge including a main body, a cover member, and an insulating seal member, which are components for constituting the ink cartridge for an inkjet printer, wherein the main body and the cover member are bonded to each other with an electrically-disbonding adhesive having a characteristic of causing a bond dissociation with a passage of an electric current so as to form an ink storing section, the main body has a first electrode for passing the electric current through the electrically-disbonding adhesive, the cover member has a second electrode for passing the electric current through the electrically-disbonding adhesive, the seal member is arranged in the vicinity of a bonding portion where the main body and the cover member are bonded to each other so as to prevent an ink stored in the storing section from being in contact with the first and the second electrodes.

12 Claims, 9 Drawing Sheets

INK CARTRIDGE AND ITS RECYCLING METHOD

CROSS-REFERENCE TO RELATED APPLICATION

This application is related to Japanese Patent Application No. 2007-249578 filed on Sep. 26, 2007, whose priory is claimed and the disclosure of which is incorporated by reference in its entirety.

BACKGROUND OF THE INVENTION

1. Field of the Invention

The present invention relates to an ink cartridge and its recycling method.

2. Description of the Related Art

An image forming apparatus that forms an image by utilizing an inkjet system can form a high-quality image with a simple operation. Further, maintenance and management of the image forming apparatus is simple. Therefore, it has widely spread, i.e., it is mostly used for a home-use printer.

In a general inkjet printer, ink droplets are ejected from a nozzle of a print head that moves parallel to a printed matter to carry out a printing or drawing. The print head also has a detachable ink cartridge mounted thereto with the nozzle, in which ink in the ink cartridge is supplied to the print head. When the ink in the ink cartridge is consumed, a user removes the empty ink cartridge, and sets a new ink cartridge.

Because consciousness for a recent environmental issue has grown more and more, a wasted ink cartridge is reused without being discarded in most cases. Specifically, the wasted ink cartridge is cleaned, new ink is filled therein, and the resultant is shipped. It is necessary to fill ink after an inside of the ink cartridge is cleaned upon recycling the ink cartridge, so that easy-to-disassemble structure is demanded.

Meanwhile, ink for an inkjet printer (hereinafter simply referred to as ink) is easy to leak since it is liquid. Therefore, a bonding portion of a container storing ink should completely be bonded, for example by welding, in order to prevent the ink from leaking from an inside of the inkjet printer or from a gap of the ink cartridge during transportation by a ship, a vehicle or the like. Accordingly, upon recycling the ink cartridge, workability is remarkably poor, since the ink cartridge should be cleaned after it is punched, dried after the cleaning operation, and filled with ink. There are many cases in which an ink cartridge is discarded without being recycled due to a breakdown and the like. It has been demanded a technique that can easily separate the bonded cartridge member without being broken down upon recycling the ink cartridge.

On the other hand, an electrically-disbonding adhesive has been known as one kind of an adhesive. The electrically-disbonding adhesive has a characteristic that a bond dissociation is caused when an electric current flows, so that it is easy to be peeled because adhesive strength at a bonding interface is weakened (e.g., refer to Japanese Unexamined Patent Publication No. 2003-504504). As one usage utilizing the characteristic of the electrically-disbonding adhesive, there has been proposed that the electrically-disbonding adhesive is used for fixing a vibration damper of a cold-cathode tube for a television set (e.g., refer to Japanese Unexamined Patent Publication No. 2005-33734).

The electrically-disbonding adhesive has a characteristic of reducing the adhesive strength when an electric current flows therein, so that it can easily be peeled from a member to which the adhesive is applied. Therefore, it is suitable for bonding a member that should be separated upon the recycle. However, when the electrically-disbonding adhesive is used as it is for an ink storing member that stores liquid having conductivity such as ink, an electric current flows in the ink when a voltage is applied to an electrode, whereby the electric current does not flow in the electrically-disbonding adhesive, thereby entailing a problem of not being able to peel the electrically-disbonding adhesive.

SUMMARY OF THE INVENTION

The present invention has been accomplished in view of the above circumstance, and aims to provide an ink cartridge that has no ink leakage during transportation in which it is subjected to a vibration for a long time, and that is easy to be recycled. Further, the present invention provides a recycling method of an ink cartridge that is excellent in workability upon recycle.

The present invention provides an ink cartridge including a main body, a cover member, and an insulating seal member, which are components for constituting the ink cartridge for an inkjet printer, wherein the main body and the cover member are bonded to each other with an electrically-disbonding adhesive having a characteristic of causing a bond dissociation with a passage of an electric current so as to form an ink storing section, the main body has a first electrode being arranged at a portion where the main body is in contact with the electrically-disbonding adhesive for passing the electric current through the electrically-disbonding adhesive, the cover member has a second electrode being arranged at a portion where the cover member is in contact with the electrically-disbonding adhesive for passing the electric current through the electrically-disbonding adhesive, the seal member is arranged in the vicinity of a bonding portion where the main body and the cover member are bonded to each other so as to keep the cartridge liquidtight, and so as to prevent an ink stored in the storing section from being in contact with the first and the second electrodes.

From another aspect, the present invention provides a recycling method of the aforementioned ink cartridge, including the steps of: peeling the electrically-disbonding adhesive through the application of a voltage between the first electrode and the second electrode; and separating the main body and the cover member.

In the ink cartridge according to the present invention, a main body and a cover member are bonded with an electrically-disbonding adhesive, and sealed liquidtightly with a seal member. Therefore, the ink cartridge has a liquidtightness capable of preventing the ink spill, even under vibration during the transportation. In the used ink cartridge, the main body and the cover member are easily disassembled by applying a voltage between the first electrode at the main body and the second electrode at the cover member and passing the electric current through the electrically-disbonding adhesive via the first and second electrodes. Therefore, the components constituting the ink cartridge are not broken upon disassembling the ink cartridge, so that the inside of the ink cartridge can easily be cleaned, and the consumables are easily be exchanged. Specifically, the recycle of the ink cartridge excellent in workability can be performed.

The electrically-disbonding adhesive has a characteristic that a bond dissociation is caused when an electric current flows, so that it is easy to be peeled because adhesive strength at a bonding interface is weakened. However, when the electrically-disbonding adhesive is used as it is for the main body that stores liquid having conductivity such as ink, the electric current flows in the ink when a voltage is applied to an electrode, whereby the electric current does not flow in the electrically-disbonding adhesive, thereby entailing a problem of not being able to peel the electrically-disbonding adhesive. When a pigment contained in the ink is adhered onto the inner wall of the container even if there is no ink in the ink cartridge, the electric current is concentrated on the surface of the inner wall of the container, which entails a problem that the electrically-disbonding adhesive cannot be peeled since the electric current does not flow in the electrically-disbonding adhesive.

In the ink cartridge according to the present invention, the main body and the cover member are bonded with the electrically-disbonding adhesive, and an insulating seal member is provided so as to prevent direct contact between the electrode, which is an energizing member, and ink. Therefore, when a voltage is applied between the electrodes of the used ink cartridge, the electric current does not flow through the ink, but can surely flow through the electrically-disbonding adhesive. Accordingly, the electrically-disbonding adhesive can surely be peeled upon the recycle, whereby the disassembling at the bonding portion is easy, the inside of the ink cartridge can easily be cleaned, and consumables of the ink cartridge can easily be exchanged. Specifically, an ink cartridge excellent in recycling workability can be obtained.

According to the recycling method of the present invention, the voltage is applied between the electrode of the main body and the electrode of the cover member so as to flow the electric current through the electrically-disbonding adhesive, whereby the electrically-disbonding adhesive can surely be peeled. Therefore, the ink cartridge can easily be disassembled and cleaned without causing the breakdown of the ink cartridge. Specifically, the recycling method having excellent workability can be realized.

The preferred aspects of the present invention will be described below.

The seal member may be arranged so as to be in contact with the vicinity of the bonding portion at the wall surface of the main body constituting the storing section and the vicinity of the bonding portion on the wall surface of the cover member constituting the storing section.

In the ink cartridge according to the present invention for solving the above problem, the electrically-disbonding adhesive may be an epoxy-based adhesive. One specific example of the electrically-disbonding adhesive is the "ElectRelease" (trade name) (registered trademark) by EIC Laboratories, Inc.

The seal member may be made of a rubber material having elasticity.

With this structure, since the rubber material having high tightness is used as the seal member, ink is not brought into contact with the electrode or the electrically-disbonding adhesive even if a vibration is applied for a long time during the transportation. Therefore, there is no chance that the electric current flows through the ink when the electric current flows into the electrically-disbonding adhesive, resulting in that the electrically-disbonding adhesive can surely be peeled.

Alternatively, the seal member may be made of a fluororesin.

With this structure, since the seal member made of fluororesin repels the ink, it is prevented that the ink enters from the gap to be in contact with the electrodes or electrically-disbonding adhesive. Therefore, there is no chance that the electric current leaks into the ink when the electric current flows into the electrically-disbonding adhesive, resulting in that the electrically-disbonding adhesive can surely be peeled.

Further, the main body may be a container including a bottom portion and a side wall portion, wherein a top portion is open, the cover member may be made of an upper cover that covers the opening at the top portion of the main body and a rib that is fitted to the opening, and an edge of the upper cover may be bonded to an upper edge of the side wall portion of the main body, and the seal member may be arranged between the rib of the cover member and the side wall portion of the main body.

Moreover, the first and the second electrodes may have a U-shape for covering respectively the edge of the side wall portion and the edge of the upper cover.

With this structure, the electrodes can firmly be fixed to the ink storing member. Accordingly, the electrodes are difficult to be separated from the ink storing member when the electrically-disbonding adhesive is peeled, whereby the ink cartridge having excellent durability in the recycle can be obtained.

Further, the main body may be a container having a polyhedron shape, and an opening is formed in its one plane, the cover member is arranged to cover the opening, and bonded to the main body around the opening, and the seal member may be arranged between a portion where the cover member is bonded to the main body and the opening.

Moreover, the main body may have a convex portion formed between a portion where the seal member is arranged and a portion where the cover member is bonded to the main body, wherein the convex portion may have a height by which a gap for allowing the electrically-disbonding adhesive to apply between the main body and the cover member can be secured.

This structure can prevent the defect that the cover member and the electrode are in direct contact with each other with no electrically-disbonding adhesive therebetween, so that the current for the peeling does not well flow through the electrically-disbonding adhesive.

The cover member may be made of copper.

With this structure, the strength of the cover member is increased, so that the durability thereof is enhanced, and the ink cartridge, which has excellent recycling performance and can repeatedly be used, can be obtained.

In the recycling method according to the present invention, the voltage applied between the first electrode and the second electrode may be an AC voltage. With this configuration, the electrically-disbonding adhesive is difficult to remain on the bonding surface of one ink storing member or the cover, so that it is easy to completely be peeled. Therefore, workability upon re-bonding is enhanced.

The preferred aspects described above can be combined.

DETAILED DESCRIPTION OF THE PREFERRED EMBODIMENTS

The present invention will be described in detail below with reference to the drawings. It should be understood that the following description is illustrative of the invention in all aspects, but not limitative of the invention.

Figure 1:
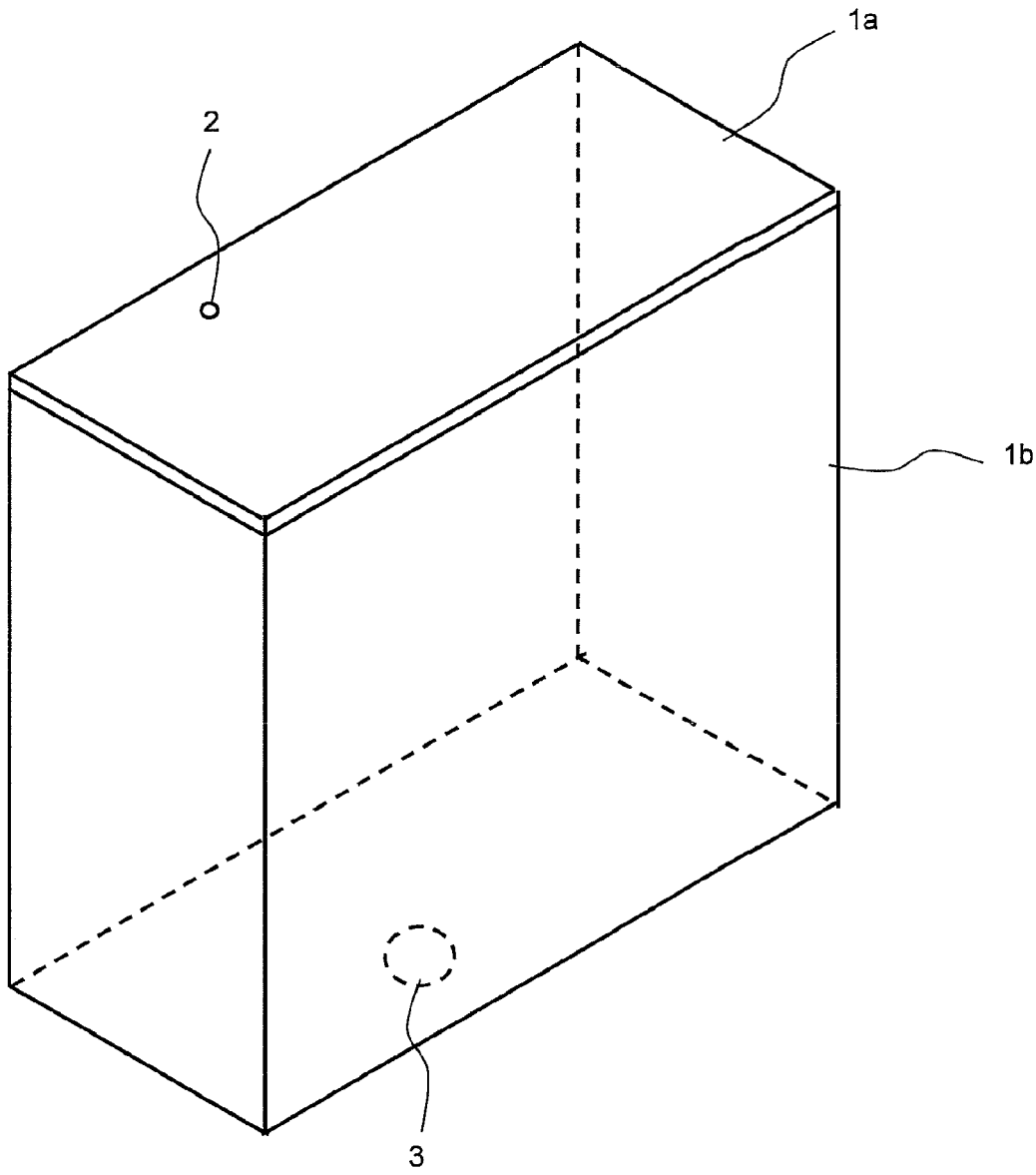
FIG. 1 is a perspective view showing an ink cartridge according to an embodiment of the present invention.

FIG. 1 is a perspective view showing an ink cartridge according to an embodiment of the present invention. In FIG. 1, an ink cartridge 10 includes an upper ink storing member (cover member) 1*a* having a vent hole 2, and a lower ink storing member (main body) 1*b* having an ink supply hole 3. The ink cartridge 10 has its inside ink and a porous member, not shown, for absorbing and retaining the ink. The vent hole 2 is formed for adjusting pressure when the ink stored in the ink cartridge 10 is consumed. The ink supply hole 3 is connected to an unillustrated print head, and ink is supplied therefrom.

Figure 2:
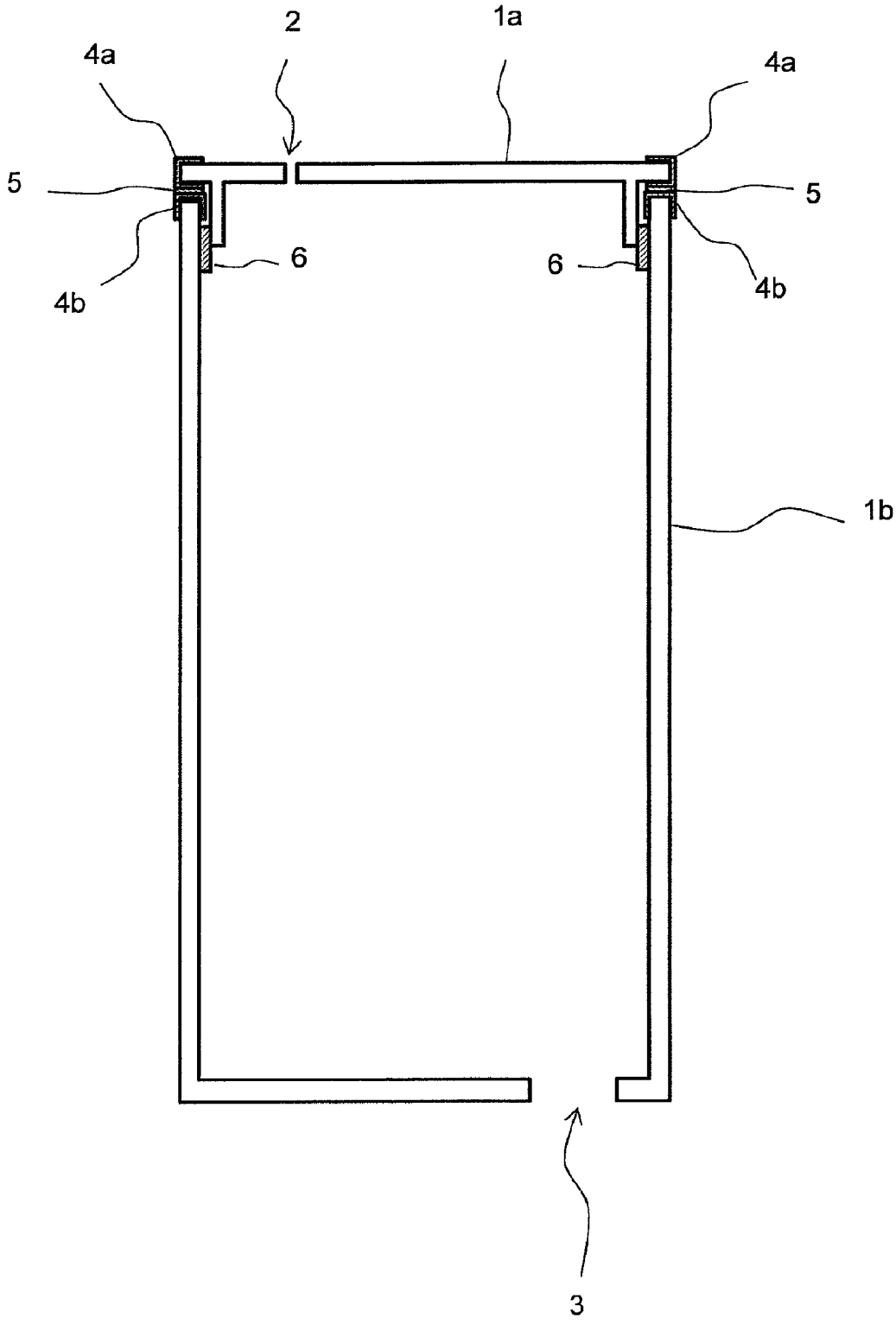
FIG. 2 is a sectional view showing a configuration of the ink cartridge according to the embodiment of the present invention.
Figure 3:
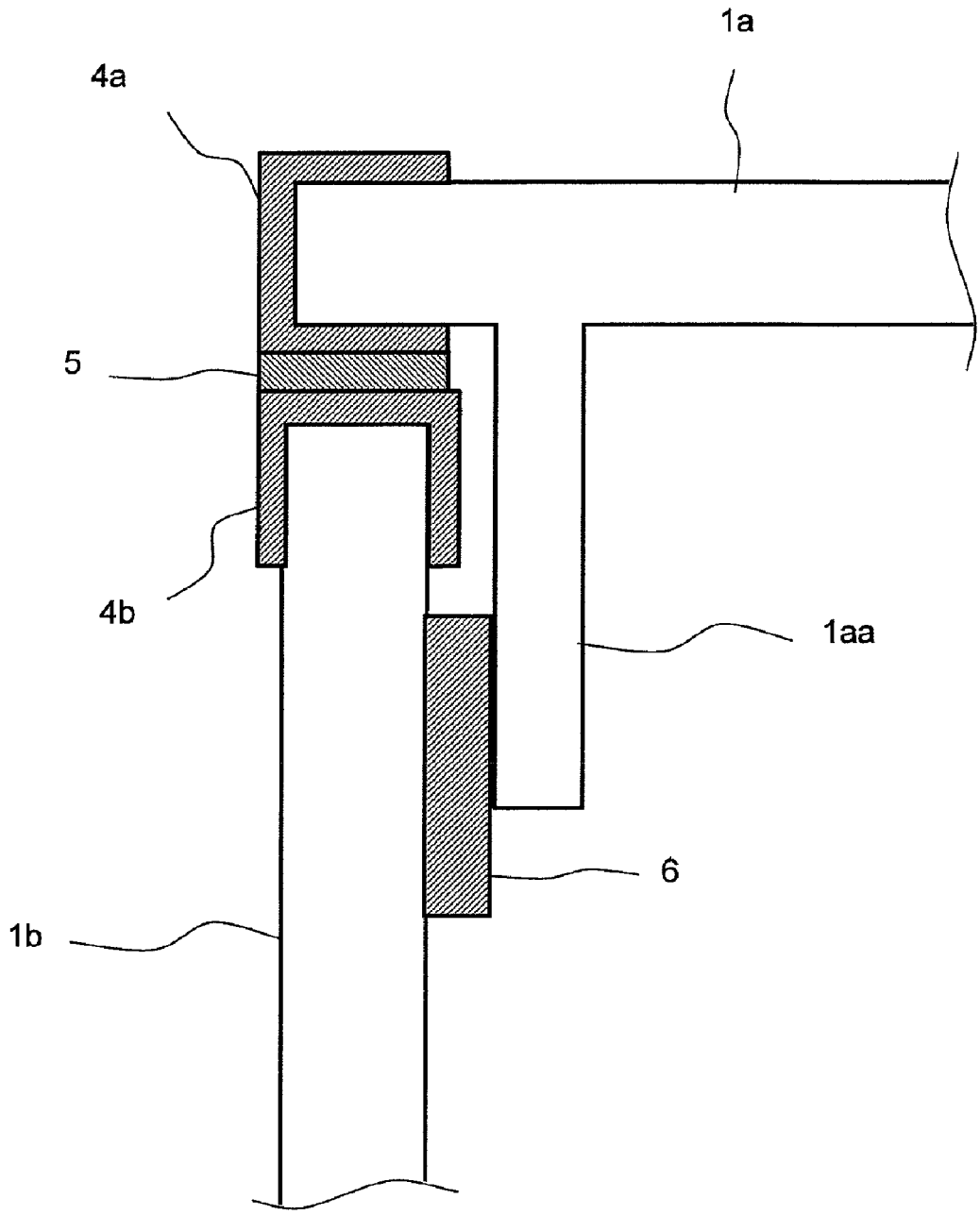
FIG. 3 is an enlarged sectional view showing a neighborhood of an electrically-disbonding adhesive in FIG. 2.

FIG. 2 is a sectional view schematically showing a structure of the ink cartridge according to the embodiment of the present invention. FIG. 3 is an enlarged sectional view showing a neighborhood of an electrically-disbonding adhesive in FIG. 2. As shown in FIGS. 2 and 3, the ink cartridge 10 is a cylindrical container formed by bonding the upper ink storing member 1*a* and the lower ink storing member 1*b*. The upper ink storing member 1*a* and the lower ink storing member 1*b* are bonded with an electrically-disbonding adhesive 5 through copper plates (electrode) 4*a* and copper plates (electrode) 4*b* formed at the end portions (bonding portion) of the upper ink storing member 1*a* and the lower ink storing member 1*b*. Examples of the usable materials for the ink cartridge 10 include a resin such as polyethylene terephthalate (PET), polycarbonate.

The copper plates 4*a* and the copper plates 4*b* have a section of a U-shape, and fixed with an adhesive so as to enclose one end of the upper ink storing member 1*a* and the lower ink storing member 1*b*. The peeling of the copper plate can be prevented due to the section of the U-shape. Therefore, the ink cartridge having excellent durability upon the repeated recycle can be obtained. Since the copper plate is exposed onto the surface of the ink cartridge, there is no need to provide an electrode for applying a voltage. The voltage may be applied to the exposed portion of the copper plate upon the recycle, whereby the stable voltage can be applied to the electrically-disbonding adhesive since the electrically-disbonding adhesive is bonded by the copper plate.

Projections 1*aa* formed at the inside of the upper ink storing member 1*a* in the vicinity of the electrodes 4*a* and seal members 6 provided at the inside of the lower ink storing member 1*b* in the vicinity of the electrodes 4*b* are arranged at the position where they are in intimate contact with each other. Since the projections 1*aa* and the seal members 6 are in intimate contact with each other, the ink filled therein is prevented from being in contact with the copper plates (electrode) 4*a*, copper plates (electrode) 4*b*, and the electrically-disbonding adhesive 5.

The electrically-disbonding adhesive has a characteristic that a bond dissociation is caused when an electric current flows, so that it is easy to be peeled because adhesive strength at a bonding interface is weakened. However, ink generally exhibits conductivity. For example, aqueous pigmented ink widely used as ink is a liquid obtained by adding a pigment to water. Examples of the pigment include carbon black, phthalocyanine-based one, quinacridone-based one, anilide-type azo-based one, etc. Pure water is electrically insulating, but when a pigment is added thereto as an impurity, ink becomes conductive. The conductivity of the ink is, for example, 1 to 15 mS/cm (mS means milisiemens, and cm means centimeter).

When the electrically-disbonding adhesive is used for the ink storing member that stores the conductive liquid described above, the electric current between the electrodes flows through the ink in the container, even if the voltage for the peeling is applied to the electrodes arranged across the electrically-disbonding adhesive, with the result that sufficient current might not be flown through the electrically-disbonding adhesive. In this case, there arises a problem that the electrically-disbonding adhesive cannot be peeled. However, the structure in which the seal members 6 are arranged as described above can surely prevent the current from leaking into the ink, when the current flows through the electrically-disbonding adhesive. Specifically, the seal members 6 prevents the ink from being in contact with the electrodes and the electrically-disbonding adhesive in order to allow the current to surely flow through the electrically-disbonding adhesive. By arranging the seal members 6, the electrically-disbonding adhesive can surely be peeled.

A rubber material having elasticity is preferable for the seal member 6. Even when a long-time vibration is applied during the transportation, there is no chance that the ink is in contact with the electrodes and the electrically-disbonding adhesive. Therefore, when the electric current flows through the electrically-disbonding adhesive, the current does not leak into the ink, whereby the electrically-disbonding adhesive can surely be peeled.

A urethane rubber or silicon rubber is preferable as a specific example of the material used for the seal member 6. These materials are chemically stable, less subject to corrosive degradation, and excellent in durability (abrasion resistance). Accordingly, the seal member 6 can repeatedly be used, and has excellent recycling performance.

A fluororesin is also preferable as another specific example of the material used for the seal member 6. Since the seal member made of fluororesin repels the ink, this seal member can prevent the ink from entering from a gap and being in contact with the electrodes and electrically-disbonding adhesive. Further, the fluororesin is chemically stable, less subject to corrosive degradation, and excellent in durability (abrasion resistance). Accordingly, the seal member 6 can repeatedly be used, and has excellent recycling performance.

Figure 4:
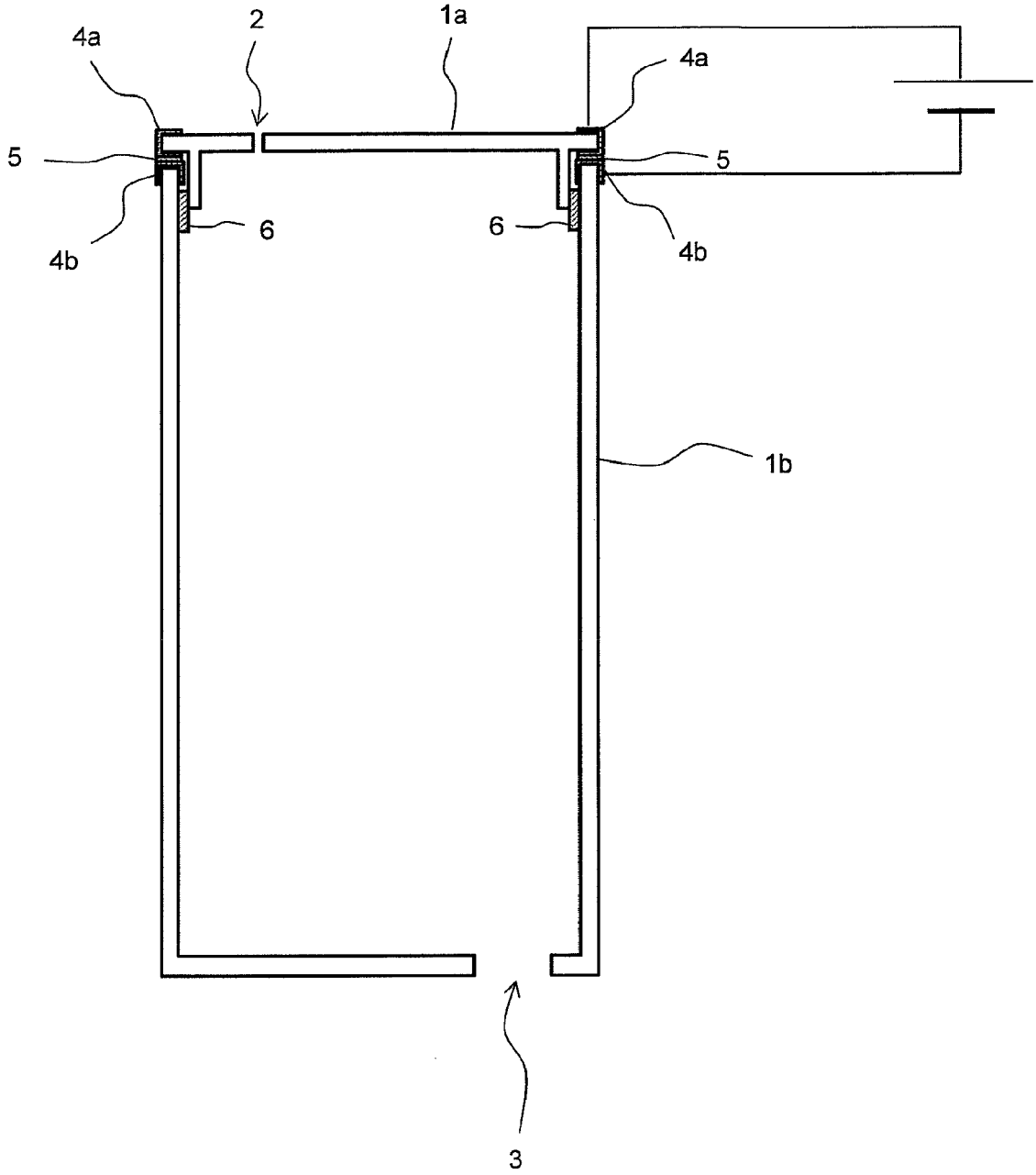
FIG. 4 is a conceptual view showing a state in which a DC voltage is applied to the ink cartridge shown in FIG. 2 across the bonding portion so as to flow an electric current through the electrically-disbonding adhesive.
Figure 5:
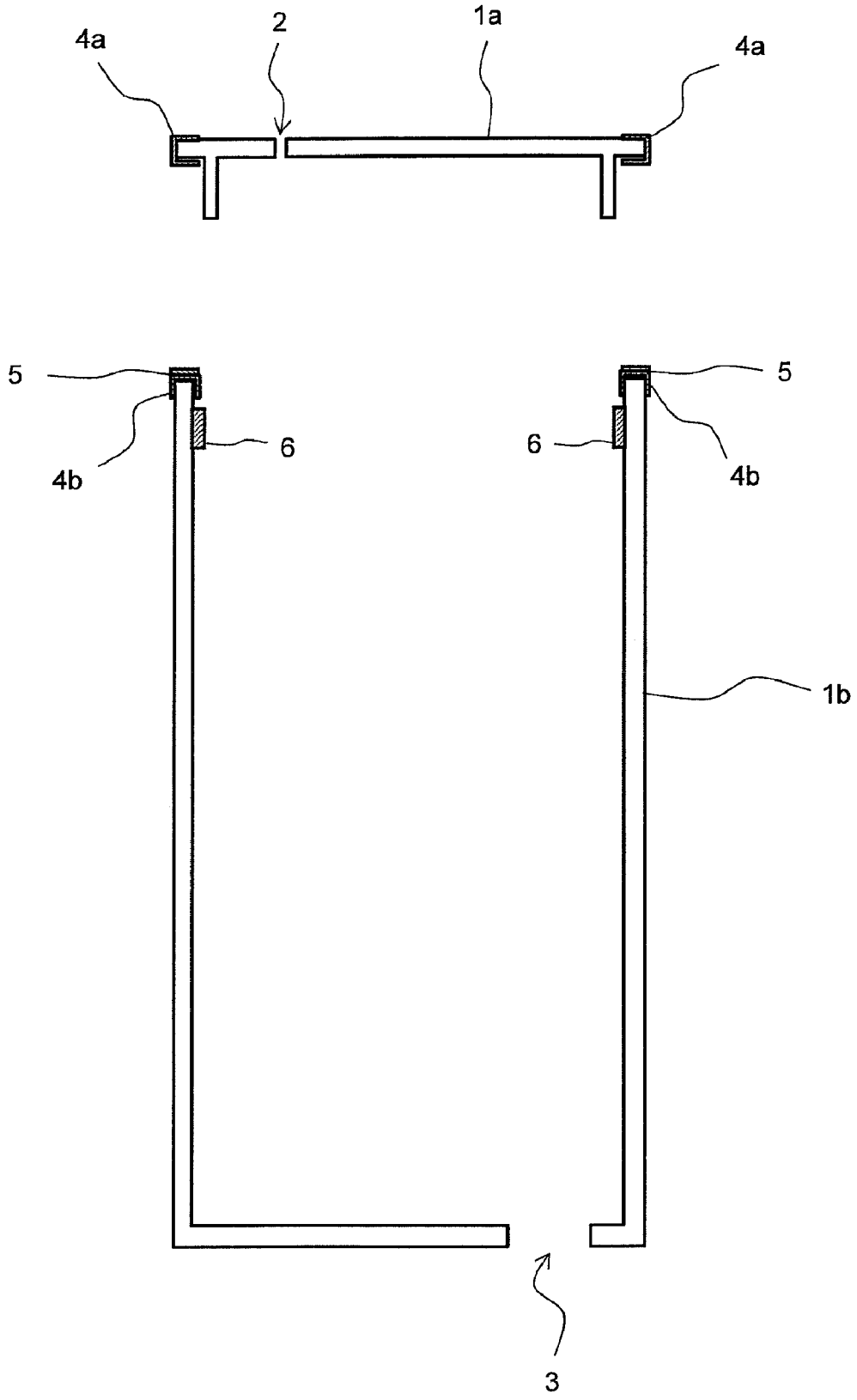
FIG. 5 is a conceptual view showing a state in which an upper ink storing member 1*a* and a lower ink storing member 1*b* of the ink cartridge shown in FIG. 4 are disassembled.

The material containing a composition that can electrochemically disbond, and causing a disbanding reaction when an electric current flows therethrough so as to weaken the adhesive strength at the adhesive interface may be used as the electrically-disbonding adhesive 5. The specific example thereof is described in Japanese Unexamined Patent Publication No. 2003-504504 described above. One specific example of the commercially available electrically-disbonding adhesive is the "ElectRelease" (trade name) (registered trademark) by EIC Laboratories, Inc. The "ElectRelease" is an epoxy-based adhesive. When an electric current flows through a bonding portion, an electrochemical reaction occurs at the interface between one bonded member and the adhesive, whereby the strength at the anode side is reduced. Further, when an electric current flows through the ElectRelease with the polarity changed, the adhesive can be completely peeled from the other bonded member. It is recommended that the voltage of about 5 to 50 V is applied to the bonding portion, and an electric current flows for about 10 seconds to several minutes during the peeling. FIG. 4 is a conceptual view showing a state in which a DC current is applied to the ink cartridge shown in FIG. 2 across the bonding portion so as to flow an electric current through the electrically-disbonding adhesive. FIG. 5 is a conceptual view showing a state in which the upper ink storing member 1*a* and the lower ink storing member 1*b* of the ink cartridge in FIG. 4 are disassembled.

As shown in FIGS. 4 and 5, in order to disassemble the wasted ink cartridge, a voltage is applied to the copper plates 4*a* and the copper plates 4*b* to flow an electric current through the electrically-disbonding adhesive 5 for reducing the adhesiveness of the electrically-disbonding adhesive, whereby the ink cartridge is disassembled into plural ink storing members.

Upon the disassembly, a voltage of several volts to several hundreds volts is applied for 5 minutes to 60 minutes, considering the time necessary for the disbonding, safety, prevention of damage to the ink storing member, or the like. The ink cartridge can easily be disassembled only by flowing an electric current through the bonding portion of the ink storing members that are bonded with the electrically-disbonding adhesive, whereby the breakdown upon the disassembly is prevented, recycling efficiency is enhanced, the inside is easily cleaned, and the consumables are easily exchanged. Specifically, the ink cartridge can be recycled with excellent workability.

The electric current necessary for releasing the bond of the electrically-disbonding adhesive is generally about $10^{-3}$ amperes per 1 square centimeter, and the voltage of about several volts to several tens of volts is enough for the electric current described above. However, the voltage of not less than several hundreds of volts is important for eliminating the resistance (in particular, the resistance around the electrodes) specific to the ink cartridge.

Figure 6:
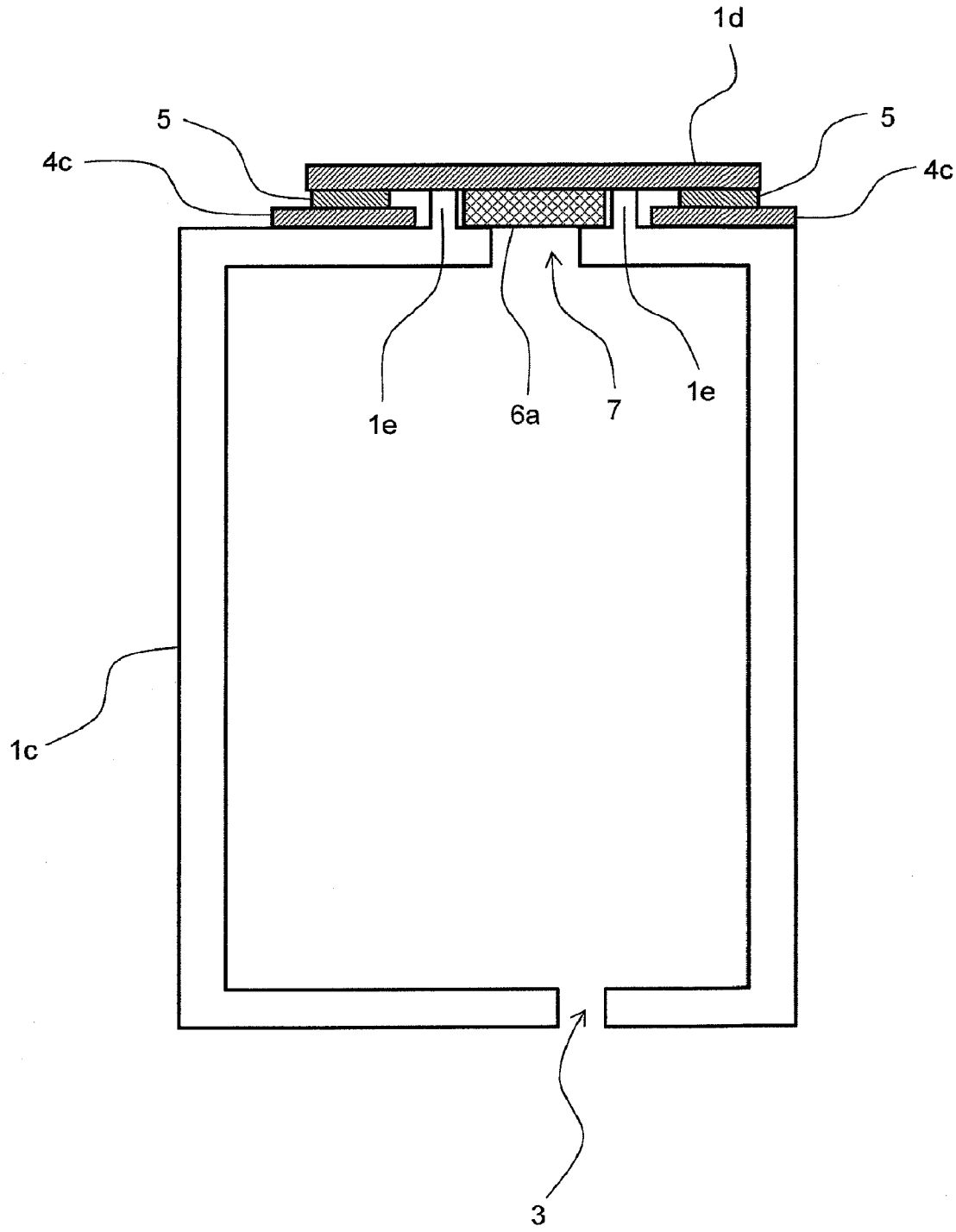
FIG. 6 is a sectional view showing another embodiment of an ink cartridge according to the present invention.

FIG. 6 is a sectional view showing another embodiment of an ink cartridge according to the present invention. In FIG. 6, the ink cartridge is composed of an ink container (main body) 1*c* having an ink supply hole 3 at its lower part and an opening 7 at its upper part, and a cover (cover member) 1*d* for closing the opening 7. An electrode 4*a* is provided in the vicinity of the opening 7. Convex portions (rib) 1*e* are formed at the edge of the opening. No special limitations are imposed on the material of the cover 1*b*, so long as it has conductivity, but a metallic material is preferable. The metallic cover has high strength, and is excellent in durability, so that an ink cartridge that can be repeatedly used and is excellent in recycling performance can be obtained. The electrically-disbonding adhesive 5 bonds the cover 1*d* and the ink container 1*c*. More specifically, the electrically-disbonding adhesive 5 is applied to the region sandwiched between the electrode 4*a* of the ink container 1*c* and the cover 1*d* so as to bond them. When the processing precision of the surface of the electrode 4*a* or the surface of the cover 1*d* on which the electrically-disbonding adhesive 5 is applied is insufficient, irregularities are produced. This might cause a local contact between the electrode 4*a* and the cover 1*d*, not through the electrically-disbonding adhesive 5. Therefore, even when the voltage is applied between the electrode 4*a* and the cover 1*d* for the peeling, the electric current leaks at the contact portion, so that the sufficient electric current does not flow through the electrically-disbonding adhesive 5, which leads to a poor peeling. The rib 1*e* is formed to prevent the phenomenon described above. Specifically, the rib 1*e* functions as a spacer for securing a predetermined space between the electrode 4*a* and the cover 1*d*. With this arrangement, the electric current for the peeling can surely flow through the electrically-disbonding adhesive 5.

As a modification, an insulating spacer may be formed at the cover 1*d* instead of the formation of the rib 1*e* at the ink container 1*c*. Alternatively, as another modification, the ink container 1*c* and the cover 1*d* may be bonded with an insulating spacer, which is an independent component, sandwiched therebetween.

Figure 7:
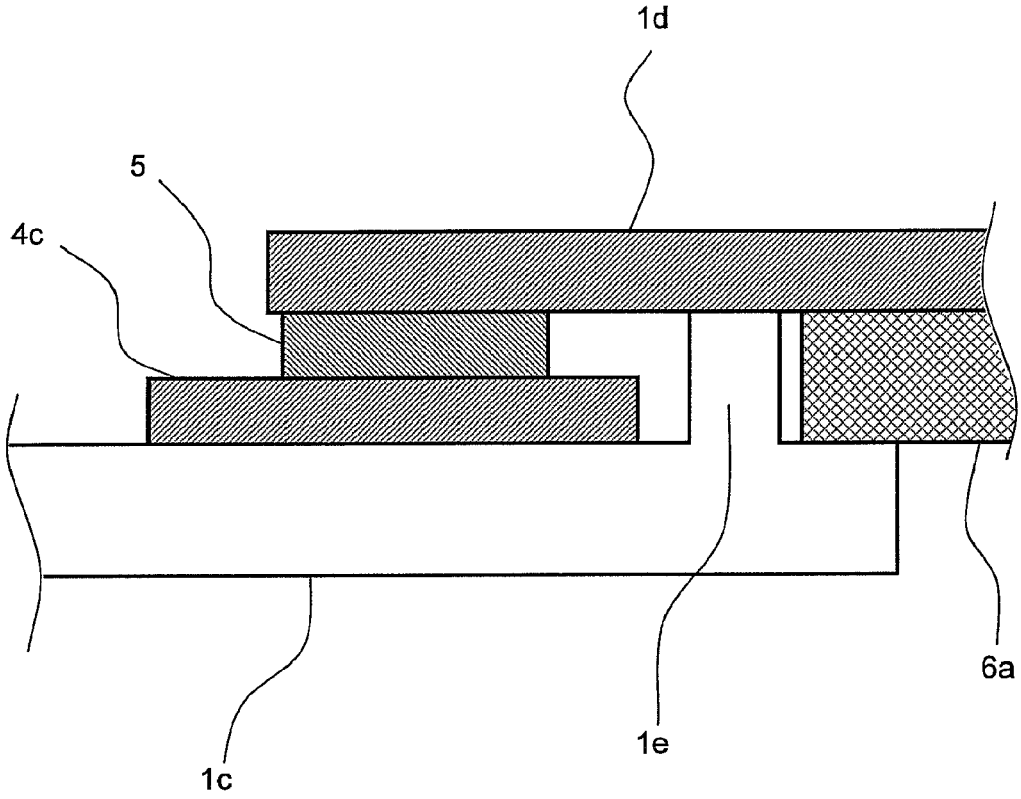
FIG. 7 is an enlarged sectional view showing a neighborhood of an electrically-disbonding adhesive in FIG. 6.
Figure 8:
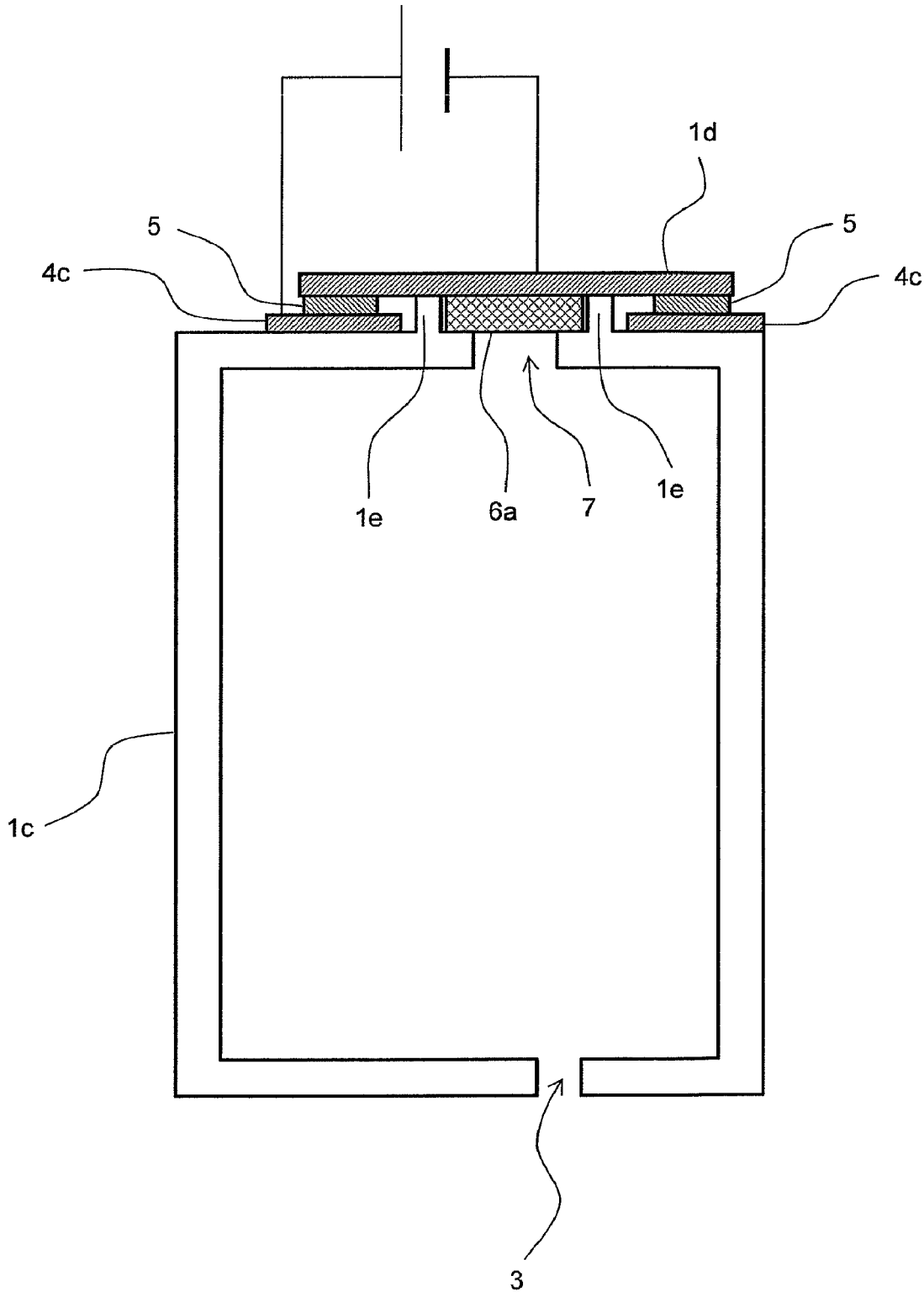
FIG. 8 is a conceptual view showing a state in which a DC voltage is applied to the ink cartridge shown in FIG. 6 across the bonding portion so as to flow an electric current through the electrically-disbonding adhesive.

A seal member 6*a* is provided to the cover 1*d*. The seal member 6*a* surely closes the opening 7 so as not to bring the ink into contact with the metallic cover 1*d*, the electrically-disbonding adhesive 5, and the electrode 4*a*. As shown in FIGS. 7 and 8, the voltage is applied between the cover 1*d* and the electrode 4*a* so as to flow the electric current through the electrically-disbonding adhesive 5 upon the peeling. Since the seal member 6*a* closes the opening 7, the ink does not leak to a energized portion where the electric current flows. Therefore, the problem in which the ink is adhered onto the energized portion to form a leak path does not arise, whereby the electric current can surely be flown through the electrically-disbonding adhesive 5 for peeling. Accordingly, the ink cartridge can easily be disassembled without being broken down, the inside thereof can easily be cleaned, and the consumables can easily be exchanged. Specifically, the ink cartridge can be recycled with excellent workability.

Figure 9:
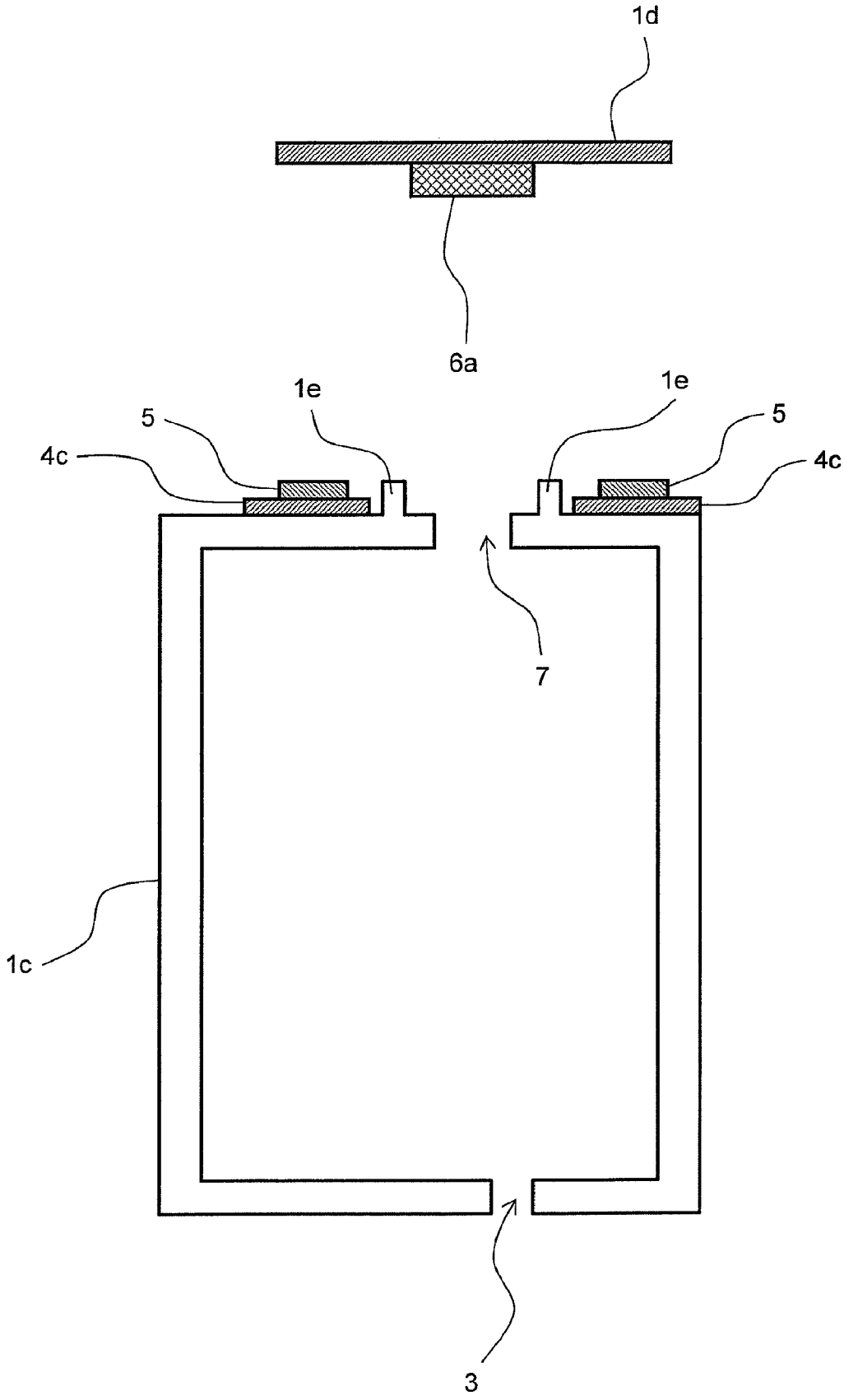
FIG. 9 is a conceptual view showing a state in which a cover and an ink container of the ink cartridge shown in FIG. 7 are disassembled.

FIG. 7 is an enlarged sectional view showing a neighborhood of the electrically-disbonding adhesive 5 in FIG. 6. FIG. 8 is a conceptual view showing a state in which a DC voltage is applied to the ink cartridge shown in FIG. 6 across the bonding portion so as to flow an electric current through the electrically-disbonding adhesive, and FIG. 9 is a conceptual view showing a state in which the cover and the ink container of the ink cartridge shown in FIG. 7 are disassembled. As shown in FIGS. 4 and 8, when the DC current flows through the bonding surface (electrode or cover) of the electrically-disbonding adhesive 5, the release of the bond occurs at one bonded surface. In the present embodiment, it is supposed that the release of the bond occurs at the anode surface. Depending upon the type of the electrically-disbonding adhesive 5, the release of the bond occurs on the cathode surface. Therefore, the electrically-disbonding adhesive remains on one bonded surface (electrode side or cover side). When an AC voltage is applied instead of the DC voltage, the bond at two bonding surfaces of the electrically-disbonding adhesive can simultaneously be released. Accordingly, the electrically-disbonding adhesive can completely be separated without remaining on one bonded surface (bonded surface of the ink storing member or the cover). Further, workability upon the re-bonding is enhanced.

Various modifications are possible for the present invention in addition to the embodiments described above. It should be understood that such modifications also fall within the aspects and scope of the present invention. The present invention is intended to embrace all alterations made within the scope of the invention defined by the appended claims and their equivalents.

What is claimed is:

1. An ink cartridge comprising a main body, a cover member, and an insulating seal member, which are components for constituting the ink cartridge for an inkjet printer, wherein the main body and the cover member are bonded to each other with an electrically-disbonding adhesive having a characteristic of causing a bond dissociation with a passage of an electric current so as to form an ink storing section, the main body has a first electrode being arranged at a portion where the main body is in contact with the electrically-disbonding adhesive for passing the electric current through the electrically-disbonding adhesive, the cover member has a second electrode being arranged at a portion where the cover member is in contact with the electrically-disbonding adhesive for passing the electric current through the electrically-disbonding adhesive, the seal member is arranged in the vicinity of a bonding portion where the main body and the cover member are bonded to each other so as to keep the cartridge liquidtight, and so as to prevent an ink stored in the storing section from being in contact with the first and the second electrodes.

2. The ink cartridge according to claim 1, wherein the seal member is arranged so as to be in contact with the vicinity of the bonding portion at the wall surface of the main body constituting the storing section and the vicinity of the bonding portion on the wall surface of the cover member constituting the storing section.

3. The ink cartridge according to claim 1, wherein the main body is a container including a bottom portion and a side wall portion, wherein a top portion is open, the cover member is made of an upper cover that covers the opening at the top portion of the main body and a rib that is fitted to the opening, and an edge of the upper cover is bonded to an upper edge of the side wall portion of the main body, and the seal member is arranged between the rib of the cover member and the side wall portion of the main body.

4. The ink cartridge according to claim 3, wherein the first and the second electrodes have a U-shape for covering respectively the edge of the side wall portion and the edge of the upper cover.

5. The ink cartridge according to claim 1, wherein the main body is a container having a polyhedron shape, and an opening is formed in its one plane, the cover member is arranged to cover the opening, and bonded to the main body around the opening, and the seal member is arranged between a portion where the cover member is bonded to the main body and the opening.

6. The ink cartridge according to claim 5, wherein the main body has a convex portion formed between a portion where the seal member is arranged and a portion where the cover member is bonded to the main body, wherein the convex portion has a height by which a gap for allowing the electrically-disbonding adhesive to apply between the main body and the cover member can be secured.

7. The ink cartridge according to claim 5, wherein the cover member is made of copper.

8. The ink cartridge according to claim 1, wherein the electrically-disbonding adhesive is an epoxy-based adhesive.

9. The ink cartridge according to claim 1, wherein the seal member is made of an elastic rubber.

10. The ink cartridge according to claim 1, wherein the seal member is made of fluororesin.

11. A recycling method of the ink cartridge according to claim 1, comprising the steps of:

peeling the electrically-disbonding adhesive through the application of a voltage between the first electrode and the second electrode; and separating the main body and the cover member.

12. The recycling method according to claim 11, wherein the voltage applied between the first electrode and the second electrode is an AC voltage.

* * * * *